US006581908B1

(12) United States Patent
Francis

(10) Patent No.: US 6,581,908 B1
(45) Date of Patent: Jun. 24, 2003

(54) DUAL CYLINDER JACK WITH INTERCHANGEABLE ATTACHMENTS

(75) Inventor: Richard Thomas Francis, Easton, MO (US)

(73) Assignee: Gray Automotive Products, Inc., St. Joseph, MO (US)

( * ) Notice: Subject to any disclaimer, the term of this patent is extended or adjusted under 35 U.S.C. 154(b) by 0 days.

(21) Appl. No.: 09/704,055

(22) Filed: Nov. 1, 2000

(51) Int. Cl.[7] ..... B66F 5/02
(52) U.S. Cl. ..... 254/2 B; 254/134
(58) Field of Search ..... 254/133 R, 134, 254/DIG. 16, 8 B, 8 R, 2 B, 2 R, 124; 269/17

(56) References Cited

U.S. PATENT DOCUMENTS

| | | | | |
|---|---|---|---|---|
| 1,325,962 A | | 12/1919 | Templeton | |
| 1,751,480 A | | 3/1930 | Howell | |
| 2,421,324 A | | 5/1947 | Graham | |
| 2,637,523 A | | 3/1953 | Lucker | |
| 2,643,779 A | | 6/1953 | Hamlin | |
| 2,747,837 A | | 5/1956 | Turner | |
| 2,748,459 A | | 6/1956 | Orr | |
| 2,802,635 A | | 8/1957 | Englebart | |
| 2,838,278 A | | 6/1958 | Johnsen | |
| 2,841,301 A | | 7/1958 | Sheriff | |
| 2,879,682 A | | 3/1959 | Parker et al. | |
| 2,976,033 A | | 3/1961 | Martin | |
| 3,028,145 A | | 4/1962 | Brand | |
| 3,087,630 A | | 4/1963 | Karnow et al. | |
| 3,109,626 A | | 11/1963 | Arnes et al. | |
| 3,136,526 A | | 6/1964 | Wolf | |
| 3,218,056 A | | 11/1965 | Kaplan et al. | |
| 3,381,953 A | | 5/1968 | Miller | |
| 3,383,894 A | | 5/1968 | Leitner | |
| 3,479,715 A | | 11/1969 | Hendrickson | |
| 3,735,958 A | * | 5/1973 | Hollingsworth | 254/2 R |
| 3,948,484 A | | 4/1976 | Tesinsky | |

(List continued on next page.)

FOREIGN PATENT DOCUMENTS

GB 382998 11/1932

OTHER PUBLICATIONS

"Under Hoist Truck Transmission Jack", Norco Industries, Inc., Catalog No. 8, 1997.
"The EVJ "Under–the–Hoist" Jack", Meyer Hydraulics Corporation Brochure, 1997.
"Transmission Jacks", Blackhawk Automotive, Catalog 3200, Jan. 1995.
"Power Train Lift", OTC Tools & Equipment for the Professional, Feb. 1997.
"Heavy Duty Professional Service Equipment Catalog", Gray, 1998.
"Transmission Jacks DFM 6110 & DFM 6315," Lift & Equipment Corporation.
"Model AH–06576" and "Model TT–2000", Automotive Resources, Inc.
"Mobile Column Lift Accessories", Stertil Koni.
"Mobile Column Lifts", Stertil Koni.

*Primary Examiner*—Robert C. Watson
(74) *Attorney, Agent, or Firm*—Shook, Hardy & Bacon L.L.P.

(57) ABSTRACT

A dual cylinder jack with interchangeable attachments is provided. The jack includes a jack assembly having a base which supports a lower pneumatic stage and an upper hydraulic stage. The distal end of the jack assembly receives a jig carriage for coupling a particular vehicle part jig to the jack assembly for use. The various part jigs are adapted and designed to cooperate with specific parts of a vehicle in mating fashion.

18 Claims, 3 Drawing Sheets

U.S. PATENT DOCUMENTS

| | | | |
|---|---|---|---|
| 3,949,976 | A | 4/1976 | Cofer |
| 3,958,793 | A | 5/1976 | Garate |
| 4,021,017 | A | 5/1977 | Adams |
| 4,066,243 | A | 1/1978 | Johnson |
| 4,118,010 | A | 10/1978 | Hanscom |
| 4,154,470 | A | 5/1979 | Dalglish |
| 4,172,316 | A | 10/1979 | Rock et al. |
| 4,358,143 | A | 11/1982 | Cullen |
| 4,479,632 | A | 10/1984 | McIntire et al. |
| 4,479,634 | A | 10/1984 | Blatz |
| 4,523,888 | A | 6/1985 | Pezzner et al. |
| 4,548,387 | A | 10/1985 | Saccoccia |
| 4,549,722 | A | 10/1985 | Gagliano |
| 4,553,727 | A | 11/1985 | Arzouman |
| 4,564,994 | A | 1/1986 | Marx |
| 4,570,905 | A | 2/1986 | Gerstner |
| 4,607,823 | A | 8/1986 | Thomas |
| 4,684,310 | A | 8/1987 | Stange |
| 4,691,904 | A | 9/1987 | Armstrong |
| 4,796,861 | A | 1/1989 | Petty |
| 4,916,792 | A | 4/1990 | Haubus |
| 5,033,717 | A | 7/1991 | Symon |
| 5,156,375 | A | 10/1992 | Liegel et al. |
| 5,190,265 | A | 3/1993 | Barry et al. |
| 5,203,540 | A | 4/1993 | Lee |
| 5,251,875 | A | 10/1993 | Craychee et al. |
| 5,358,217 | A | 10/1994 | Dach |
| 5,372,353 | A | 12/1994 | West |
| 5,779,225 | A | 7/1998 | Trost |

* cited by examiner

DUAL CYLINDER JACK WITH INTERCHANGEABLE ATTACHMENTS

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE INVENTION

The present invention relates to a device for supporting and positioning automotive components during service on an automobile. More particularly, this invention relates to a mobile, dual cylinder post jack with a plurality of vehicle component jigs designed to be interchangeable therewith. The interchangeable jigs are designed to cooperate with specific parts of a vehicle, for example, a clutch or a flywheel.

Various jacks or devices for lifting and supporting items have been developed to assist in the automotive industry. For example, U.S. Pat. No. 5,251,875 to Craychee et al. discloses a lifting device designed to assist with the installation and removal of various vehicle parts. As can be seen, these types of prior art jacks are designed to be used with vehicles which are not lifted very far off the ground during service thereon and are designed to permit the part being worked on to be lowered very close to the ground surface so the part may be removed from beneath the lowered vehicle. By having a proximal end of a pivot or lift arm pivotally coupled with a frame adjacent the ground surface, the distal or free end of the lift arm cannot readily be raised to a height sufficient to permit the jack to be used on a vehicle which has been raised high enough to allow the person making the repairs to comfortably walk thereunder. Additionally, because these jacks of the prior art use only hydraulic cylinders to position the free end of the lever arm prior to coupling with the part being worked on, substantial effort and time is needed to move the free end of the arm from its lowermost position to a raised position ready for use.

A further drawback of the lifting devices of the prior art is the amount of floor space they take up. As can be seen in the device of Craychee et al., the jack has a base frame which takes up a considerable amount of floor space. The reason for the long base, apart from stability, is a function of the length of the lever arm. In order to properly support the part being lifted, the base must be at least as long as the lever arm so that the weight of the part being lifted is positioned over the base. Accordingly, the higher one wants the jack to lift the part, the longer the lever arm must be and, in turn, the longer the base must be. Further, because of the configuration of these type prior art jacks, it is difficult to provide a plurality of attachments for the jack to permit the same lifting apparatus to be used to assist in the repair of several different vehicle components.

Therefore, there is a need for a jack which permits use on vehicles which have been raised off the ground far enough to allow a user to comfortably walk under vehicles during service thereon. There is also a need for a jack which can quickly and easily be raised and lowered from a lowermost position to an upper use position. A need also exists for a jack which does not have a large footprint and is therefore more agile. A need is also present for a jack which can readily be converted for use in connection with a number of different vehicle service operations. The present invention overcomes the drawbacks of the prior art and fills these and other needs.

SUMMARY OF THE INVENTION

In order to overcome the above-stated problems and limitations, and to achieve the noted objects, there is provided a dual cylinder jack with interchangeable attachments.

In general, the jack broadly includes a jack assembly, a vehicle part jig and a device for coupling the jack assembly to the vehicle part jig. The jack assembly has a mobile base with a jack portion positioned generally centrally thereon and supported in an upright position. The jack portion has a first pneumatic stage having a cylinder and a piston, and a second hydraulic stage, also having a cylinder and piston. The first pneumatic stage provides for rapid up and down movement of a distal end of the jack assembly. The hydraulic stage, on the other hand, provides for more precise movement of the distal end of the jack assembly. Preferably, both stages are designed to provide approximately equal lifting forces. The jack assembly terminates in the distal end, which is the highest point of the jack assembly off the ground and is opposite the base. The distal end presents a post upon which the device for coupling the jig attachment to the jack assembly is received.

In a first embodiment, where the jack is being used to work on a clutch assembly, and in a second embodiment, where the jack is being used to work on a flywheel assembly, the device for coupling the vehicle part jig to the jack assembly is a jig carriage having a base plate with a bore therethrough. The bore receives the distal end of the jack assembly and is supported thereon. The jig carriage further has opposing upstanding side walls for supporting a pivot pin. Extending from the pivot pin is an arm having a distal end which is coupled with and supports the particular vehicle part jig that is being used. The arm is pivotal from a generally horizontal position to a generally vertical position during use.

When the jack is used to work on a clutch assembly, the vehicle part jig is a clutch jig having an elongate shaft with a proximal end coupled with the distal end of the arm of the jig carriage. A splined sleeve rotatably received on the shaft for sliding engagement with the clutch assembly and handles connected to the sleeve permit the user to rotate the sleeve about the shaft and thereby align the sleeve with the clutch assembly.

When the jack assembly is used to work on the flywheel of a vehicle, the vehicle part jig is a flywheel jig. The flywheel jig, like the clutch jig, includes a shaft, which is releaseably coupled at a proximal end with the distal end of the arm of the jig carriage, and a sleeve, which is rotatably received on the shaft. At an end of the sleeve opposite the arm of the jig carriage, a to plurality of mounting bars are coupled therewith and extend radially therefrom. The mounting bars facilitate the coupling of the flywheel jig to the flywheel.

Further objects, features, and advantages of the present invention over the prior art will become apparent from the detailed description of the drawings which follows, when considered with the attached figures.

BRIEF DESCRIPTION OF THE SEVERAL VIEWS OF THE DRAWING

The features of the invention noted above are explained in more detail with reference to the preferred embodiments illustrated in the attached drawing figures, in which like reference numerals denote like elements, and in which.

DETAILED DESCRIPTION OF THE INVENTION

Figure 1:
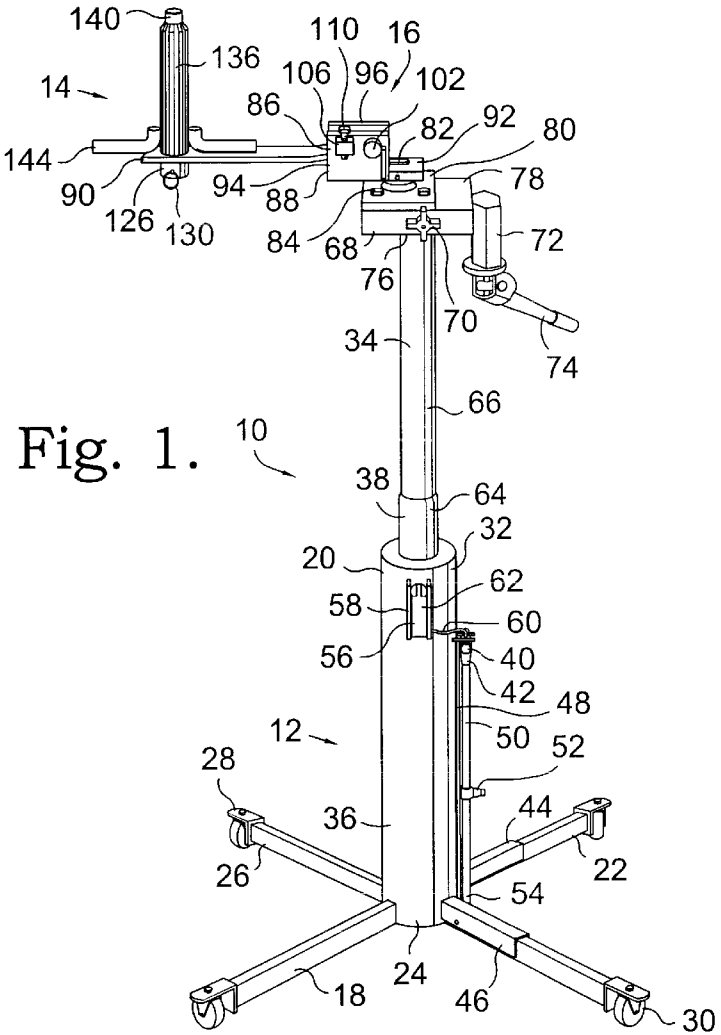
FIG. 1 is a perspective view of a jack of the present invention with a clutch jig attached thereto.

Referring initially to FIG. 1, numeral 10 generally designates a dual cylinder jack with interchangeable attachments of the present invention. The jack 10 includes a jack assembly 12, a vehicle part jig 14 and a device 16 for coupling the vehicle part jig 14 with the jack assembly 12.

The jack assembly 12 includes a base 18 and a jack portion 20. The base 18 preferably includes four legs 22 which extend radially outward from a central location 24. To make the jack mobile, each of the legs 22 preferably terminate at a distal end 26 with a caster bracket 28. Each of the caster brackets 2,8, in turn, preferably have a swivel caster 30 attached thereto.

The jack portion 20 is supported by the base 18 and is preferably positioned centrally thereon adjacent the central location 24 of the base 18. Alternatively, the jack portion 20 may be the central location 24 from which the legs 22 extend, as illustrated in FIG. 1. The jack portion 20 extends upwardly from the central location 24 in a generally vertical orientation. The jack portion 20 is an elongate column-like structure that consists of a lower pneumatic stage 32 in an upper hydraulic stage 34.

The pneumatic stage 32 includes a cylinder 36 which slidably receives, in telescoping fashion, a piston 38. The pneumatic stage receives compressed air from an air hose (not shown) coupled on one end to an air compressor (not shown) and on another end to an air inlet 40 in a valve 42. The valve 42 controls the flow of air in and out of the cylinder 36. The valve is controlled by an up pedal 44 and a down pedal 46. The pedals 44, 46 are operated by the user's foot and are coupled with the valve 42 via rods 48. The air flows from the valve 42 to the cylinder 36 through an upper pipe 50, a regulator 52 and a lower pipe 54. A locking pawl 56 is positioned on a side of the cylinder 36 to permit the user to lock the piston 38 in its extended position. The locking pawl 56 includes a bracket 58 which rotatably supports an activating bar 60 that has a pawl 62 attached thereto. When desired, the pawl 62 is moved into engagement with a lower end of the piston 38 by rotating the activating bar 60.

Figure 6:
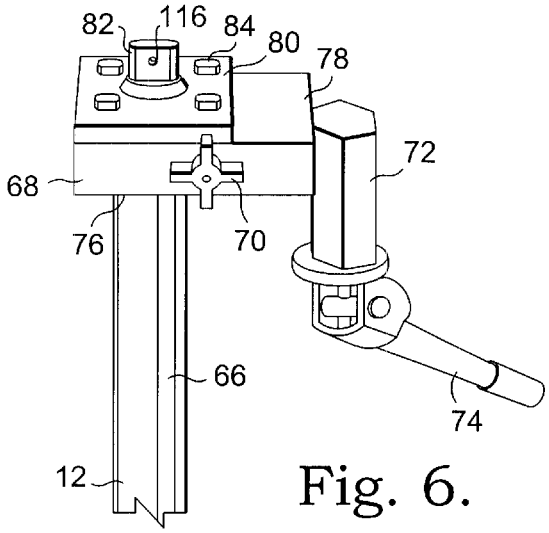
FIG. 6 is a fragmentary perspective view of a distal end of the jack of the present invention.

The hydraulic stage 34 includes a cylinder 64, a piston 66, a hydraulic block 68, a release valve 70, a hydraulic pump 72 and a pump handle 74. As can be seen, the hydraulic stage 34 is on top of the pneumatic stage 32 such that when the pneumatic stage is operated, the entire hydraulic stage is raised and lowered. More specifically, the piston 38 of the pneumatic stage 32 receives the piston 66 of the hydraulic stage 34 and functions as the cylinder 64 for the hydraulic 20 stage 34. The hydraulic block 68 is positioned on a distal end 76 of the piston 66 and jack assembly 12. The block 68 includes the release valve 70 for releasing hydraulic pressure in the hydraulic stage 34 to lower the piston 66 into the cylinder 64. Mounted to an upper surface 78 of the hydraulic block 68 is a mounting plate 80 having a post 82 extending upwardly therefrom. The mounting plate 80 is preferably bolted to the hydraulic block 68 by bolts 84. However, the mounting plate 80 can be attached to the hydraulic block 68 by any conventional means, such as welding. Additionally, while the post can have a circular cross-section, the post 82 is preferably of a non-circular cross-section and, more particularly, of an oblong cross-section as illustrated in FIG. 6. The post 82 is provided for receiving the device 16 for coupling the vehicle part jig 14 to the jack assembly 12 as explained in further detail below.

Figure 3:
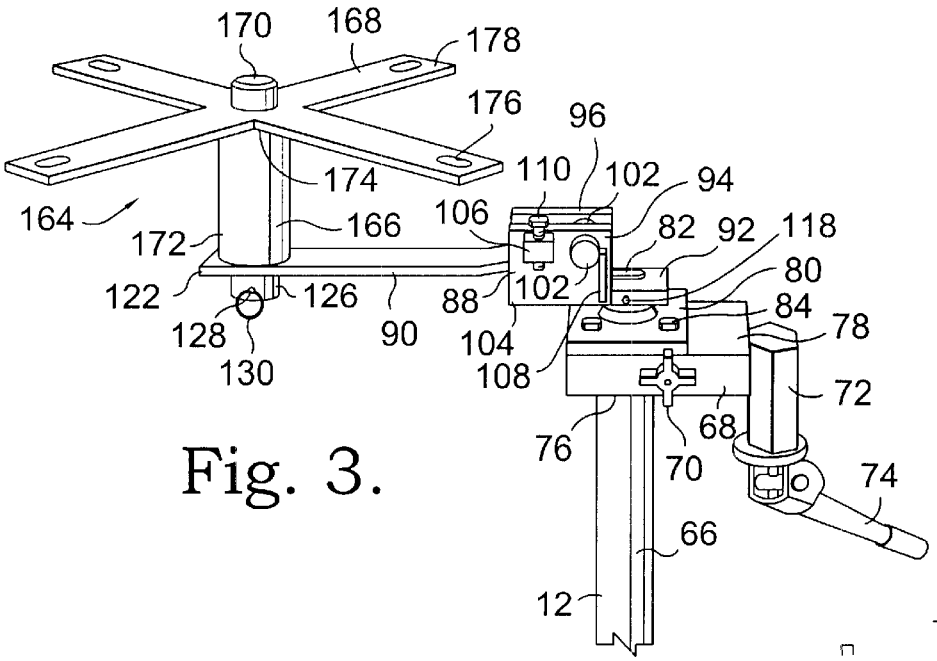
FIG. 3 is a fragmentary perspective view of the jack of the present invention with a flywheel jig attached thereto.
Figure 4:
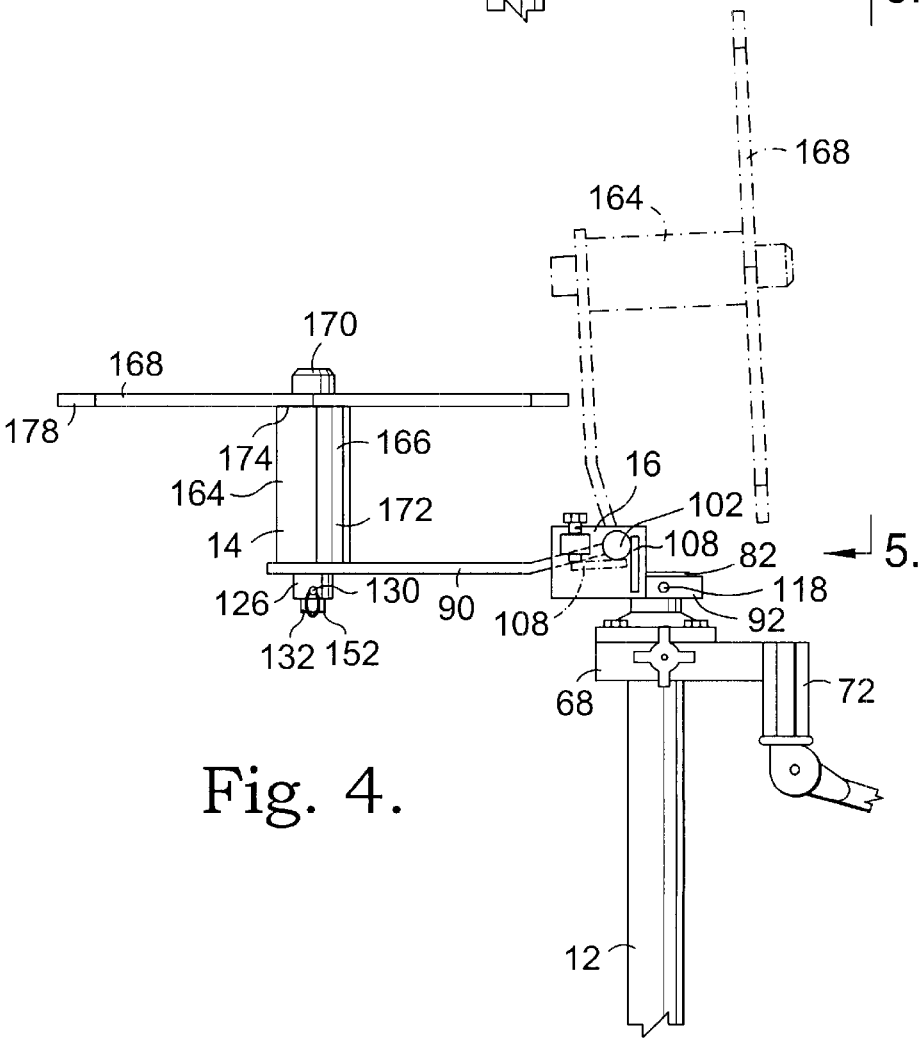
FIG. 4 is a fragmentary side elevational view of the jack of the present invention with the flywheel jig attachment of FIG. 3 and illustrating the pivotal movement permitted by the jig carriage.
Figure 5:
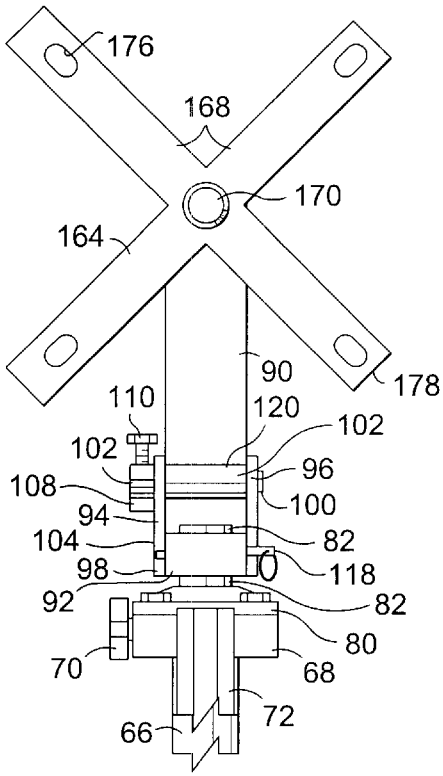
FIG. 5 is a front elevational view of the flywheel jig of FIG. 4 in a raised position and taken generally along lines 5—5.

The device 16 for coupling a vehicle part jig 14 with the jack assembly 12 is illustrated in FIGS. 1–5 and is a jig carriage 86. The jig carriage 86 can be used to couple a variety of different jigs to the jack assembly 12. The jig carriage 86 has a body 88 and an arm 90. The body 88 includes a base plate 92 and first and second side walls 94, 96. As best illustrated in FIG. 5, the side walls. 94, 96 are connected to the base plate 92 on opposite sides thereof adjacent their lower ends 98 to provide a U-shaped piece. Each of the side walls include a bore 100 therethrough for receiving a pivot pin 102 therethrough in a generally horizontal orientation. On an outer surface 104 of the first side wall 94 the body 88 includes a stop block 106 for limiting rotation of the arm 90 by abutting a stop flange 108, as will be discussed in more detail below. Stop block 106 preferably threadably receives an adjustment bolt 110 for selectively varying the orientation of the arm 90 in the raised position as illustrated in FIG. 5.

The base plate 92 preferably further includes a first bore 112 and a second bore 114. The first bore 112 has a generally vertical orientation. The first bore 112 is sized to receive the post 82 of the jack assembly 12. Accordingly, the first bore 112 preferably has an oblong cross-section that corresponds with that of the post 82. The second bore 114 is preferably horizontal in orientation and aligns with a bore 116 in the post 82. The second bore 114 and the bore 116 in the post 82 receive a locking pin 118 for securing the jig carriage 86 to the jack assembly 12. The oblong nature of the mating post 82 and first bore 112 not only prevents the base plate 92 from rotating around the post 82, but it also assures that the second bore 114 and the bore 116 in the post 82 are co-axial for receiving the locking pin 118.

Figure 7:
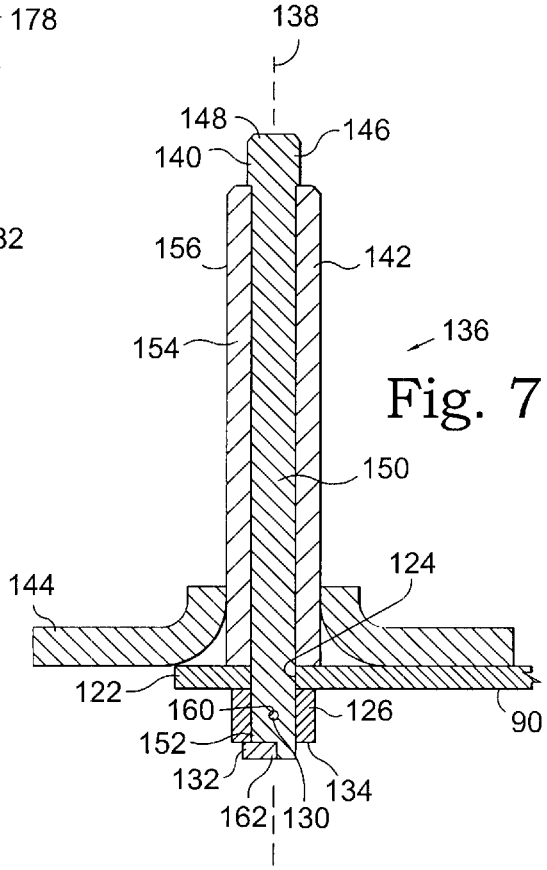
FIG. 7 is a cross-sectional view of the clutch jig taken generally along lines 7—7 of FIG. 2.

The arm 90 is preferably an elongate metal plate having a proximal end 120 and a distal end 122. The proximal end 120 of the arm 90 preferably terminates in the pivot pin 102, which is transverse to the arm 90. Accordingly, as the pivot pin 102 is rotatably received in the bores 100 and thereby supported by the side walls 94, 96, the arm 90 is pivotal between a first generally horizontal position, as illustrated in FIGS. 1–4, and a second raised or generally vertical position, as illustrated in FIG. 5 and in dash lines in FIGS. 2 and 4. The arm 90 includes a bore 124 to therethrough at the distal end 122, as best illustrated in FIG. 7. The arm preferably also includes an annular collar 126 which is welded or otherwise affixed to the arm adjacent to and aligned with the bore 124 to facilitate coupling the arm 90 with a vehicle part jig 14. The collar 126 includes a bore 128 therethrough for receiving a locking pin 130. A crossbar 132 is preferably secured to a bottom end 134 of the collar 126.

Figure 2:
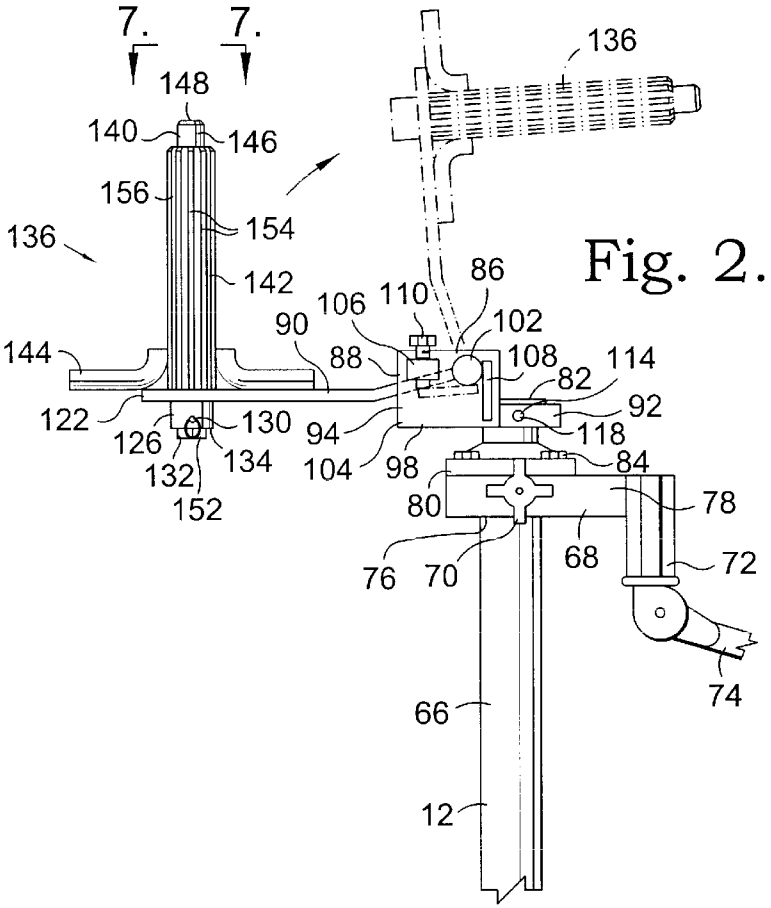
FIG. 2 is an enlarged fragmentary side elevational view of the clutch jig attachment of FIG. 1 illustrating the pivotal movement permitted by a jig carriage.

One of the vehicle part jigs 14 of the present invention to be used with the jig carriage 86 is a clutch jig 136, which is illustrated in FIGS. 1, 2 and 7. The clutch jig 136 is an elongate cylindrical member having a longitudinal axis 138. Preferably, the clutch jig 136 includes a shaft 140, a sleeve 142 and handles 144. The shaft 140 preferably includes an enlarged portion 146 adjacent a distal end 148 of the clutch jig, a central portion 150 and a proximal portion 152.

The sleeve 142 is tubular in nature and preferably includes a plurality of splines 154 on an outer surface 156 thereof. The splines 154 are generally parallel to the longitudinal axis 138 of the clutch jig 136. The sleeve 142 includes a longitudinal bore 158 having an inner circumference which is slightly greater than an outer circumference of the central portion 150 of the shaft 140 to permit the sleeve 142 to freely rotate about the shaft 140. The enlarged portion 146 has an outer circumference which is slightly greater than the inner circumference of the sleeve 142 to prevent the sleeve 142 from sliding off the distal end 148 of the shaft 140 during use. It should be noted that while the present invention discloses a clutch jig 136 having a separate shaft 140 and sleeve 142, it is well within the scope of the present invention to provide a one piece clutch jig. However, it has been found beneficial to provide the present two piece arrangement to permit a wide variety of different sized sleeves to be used with a single shaft, thereby allowing the user to work on several different types of clutch assemblies, and to permit the user to rotate the sleeve 142 about the shaft 140 to align the splines 154 with the clutch assembly.

The proximal portion 152 of the shaft 140 includes a bore 160 therethrough and a notch 162. The bore 160 in the shaft 140 aligns with the bore 126 through the annular collar 126 and receives the locking pin 130 when the proximal portion 152 of the shaft 140 is received in the bore 124 of the arm 90. The notch 162, as best illustrated in FIG. 7, cooperates with and fits around the crossbar 132 on the bottom end 134 of the annular collar 126. In this manner, when the crossbar 132 is received in the notch 162, as illustrated, the bore 160 in the shaft 140 is aligned with the bore 126 through the annular collar 126. Additionally, as with the mating relationship between the oblong post 82 and the oblong first bore 112, the relationship between the crossbar 132 and the notch 162 works with the locking pin 130 to prevent the shaft 140 from rotating in the bore 124 in the arm 90 and in the annular collar 126 during use.

When it is desired to use the jack of the present invention to work on a flywheel assembly, the vehicle part jig 14 is a flywheel jig 164, as illustrated in FIGS. 3, 4 and 5. As stated above, the jig carriage 86 can be used with both the clutch jig 136 and the flywheel jig 164. The flywheel jig includes a hub 166 with a plurality of mounting bars 168 extending therefrom. While the hub 166 can be a single piece, as with the clutch jig 136, the hub 166 is preferably a two-piece construction having a shaft 170 and a sleeve 172. The shaft 170 and sleeve 172 of the flywheel jig 164 cooperate in the same manner that the shaft 140 and sleeve 142 of the clutch jig 136 cooperate as described above. Accordingly, the sleeve 172 can be freely rotated about the shaft 170 to align the flywheel jig 164 with the flywheel of a vehicle.

The mounting bars 168 are preferably connected to a distal end 174 of the sleeve 172 and extend radially outwardly therefrom. Preferably, the mounting bars form an X shape and have an aperture 176 through distal ends 178 thereof to facilitate coupling the flywheel jig to the flywheel. The shaft 170 is similar in shape and function to the shaft 140 of the clutch jig 136.

In use, with the desired vehicle part jig 14 coupled with the jack assembly 12, the user first raises the vehicle part jig 14 to its approximate height by stepping on the up peddle 44, thereby causing the piston 38 to extend from the cylinder 36 of the lower pneumatic stage 32, which in turn raises the distal end 76 and the vehicle part jig 14. The user can then fine tune the height of the vehicle part jig by activating the upper hydraulic stage 34 with the pump handle 72. The user then moves the vehicle part jig 14 into matting cooperation with the particular vehicle part desired to be worked on by moving the jack 10 across the floor of the work area by way of the casters 30. If additional adjustment of the height orientation of the vehicle part jig 14 is necessary to mate the vehicle part jig 14 with the vehicle part, the user does so now. For example, if the vehicle part jig is way too high, the user can lower the vehicle part jig 14 some by stepping on the down peddle 46. However, the part jig is preferably lowered by unscrewing the release valve 70 in the hydraulic box 68 of the hydraulic stage 34 and then tightening the release valve 70 when the desired height is reached.

When the clutch jig 136 or flywheel jig 164 is being used, the user might need to rotate the sleeve 142, 172 of the jig to get the jig to align with the part being worked on. For example, if the clutch jig 136 is being used, the user might need to rotate the sleeve 142 about the shaft 140 by way of the handles 144 to get the splines 154 to align with the corresponding grooves in the clutch assembly. Similarly, if the user is using the flywheel jig 164, the user might have to rotate the sleeve 172 about the shaft 170 to get the apertures 176 to align with the corresponding apertures in the flywheel assembly.

Once the vehicle part jig 14 is mated with its corresponding vehicle part, the user can lift the part from the vehicle by activating the hydraulic pump 72 with the pump handle 74. The user do can then move the jack away from the vehicle while supporting the vehicle part thereon.

Whether the user is using the clutch jig 136 or the flywheel jig 164, the user can move the jig from a generally horizontal orientation to a generally vertical orientation by way of the pivoting arm 90, as illustrated in FIGS. 2 and 4. Generally, when the clutch jig 136 or flywheel jig 164 is being coupled with the vehicle part, the jig is in a generally horizontal orientation, as illustrated by the dash marks of FIGS. 2 and 4. If the user needs to adjust the tilt of the jig while the arm 90 is in the general vertical position, the user may do so by moving the bolt 110 in and out of the stop block 106, thereby selectively changing the location at which the bolt 110 contacts the stop flange 108 and stops the pivot pin 102 from further rotation in that direction.

To switch between using the clutch jig 136 and the flywheel jig 164, or between clutch jigs or flywheel jigs of different sizes, the user simply removes the locking pin 130 from cooperation with the annular collar 126 and shaft 140, 170. The shaft 140,170 can then be removed from the bore 124 in the arm 90, thereby leaving the sleeve 142, 172 to freely slide off the end of the shaft opposite the enlarged portion 146. The desired sleeve can then be placed back on the shaft and the proximal portion 152 of the shaft can be received back into the bore 124 and annular collar 126 of the arm 90 of the jig carriage 86, the notch 162 and crossbar 132 put in mating cooperation, and the locking pin 130 received back through the bore 128 in the annular collar 126 and the bore 160 in the shaft 140. While an interchangeable system has been described where different sleeves can be used on the same shaft, it is well within the scope of the present invention to provide a dedicated shaft with each sleeve.

From the foregoing it will be seen that this invention is one well adapted to attain all ends and objects hereinabove set forth together with the other advantages which are obvious and which are inherent to the structure. It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

What is claimed is:

1. A mechanism for raising and lowering parts of a vehicle during service thereon, the mechanism comprising:

a jack assembly having a mobile base with a jack portion supported thereon in a generally upright position, wherein the jack portion has a piston and a cylinder, a portion of the piston being slidably received in the cylinder and movable along a longitudinal axis of the jack assembly between extended and retracted positions, and wherein the piston has a distal end opposite the portion received in the cylinder;

a jig carriage coupled with the distal end of the piston and having a body and an arm, the arm having a proximal end which is pivotally coupled with the body and a distal end, wherein the distal end of the arm of the jig carriage includes a bore therethrough; and a vehicle part jig removably coupled with the distal end of the arm of the jig carriage, wherein the jig is a clutch jig for adapting the mechanism to couple with a clutch of the vehicle to support and align the components of the clutch during assembly, disassembly and repair, wherein the clutch jig is an elongate cylindrical member having a longitudinal axis, and wherein the clutch jig has a plurality of splines on an exterior surface thereof for sliding engagement with the vehicle clutch, the splines being generally parallel to the longitudinal axis of the clutch jig, wherein the clutch jig includes a shaft and a sleeve, the sleeve being rotatably and removably received on the shaft, wherein the splines are located on an exterior surface of the sleeve, and wherein the clutch jig is coupled with the jig carriage by a proximal end of the shaft being removably received in the bore of the jig carriage.

2. The mechanism of claim 1, within the clutch jig further includes at least one spline handle connected to the exterior surface of the sleeve for facilitating rotation of the sleeve about the shaft during use.

3. The mechanism of claim 2, wherein the arm of the jig carriage further includes an annular collar, a pivot pin and a stop plate, wherein the annular collar is connected to the distal end of the arm adjacent and co-axial with the bore to facilitate the coupling of the shaft with the arm, wherein the pivot pin is connected to the proximal end of the arm and facilitates the pivotal coupling of the arm to the body, and wherein the stop plate is coupled with the pivot pin and prevents rotational movement of the arm past a predetermined point in at least one direction by abutting a portion of the body.

4. The mechanism of claim 3, wherein the jack portion includes two stages, one of the stages being a lower pneumatic stage and the other of the stages being an upper hydraulic stage, wherein the piston and cylinder comprise the lower pneumatic stage, wherein the upper hydraulic stage also has a piston and a cylinder, and wherein the piston of the pneumatic stage defines the cylinder of the hydraulic stage, whereby the hydraulic stage is raised and lowered in the pneumatic cylinder.

5. A mechanism for raising and lowering parts of a vehicle during service thereon, the mechanism comprising:

a jack assembly having a mobile base with a jack portion supported thereon in a generally upright position, wherein the jack portion has a piston and a cylinder, a portion of the piston being slidably received in the cylinder and movable along a longitudinal axis of the jack assembly between extended and retracted positions, and wherein the piston has a distal end opposite the portion received in the cylinder;

a jig carriage coupled with the distal end of the piston and having a body and an arm, the arm having a proximal end which is pivotally coupled with the body and a distal end; and a vehicle part jig removably coupled with the distal end of the arm of the jig carriage, wherein the jig is a flywheel jig for adapting the mechanism to couple with a flywheel of the vehicle to support and align the components of the flywheel during assembly, disassembly and repair, wherein the flywheel jig has a hub with a plurality of mounting bars extending therefrom at a distal end, each of the mounting bars having distal ends spaced apart from the hub, wherein the flywheel jig is coupled to the distal end of the arm of the jig carriage at a proximal end of the hub, and wherein the distal ends of the mounting bars include an aperture therethrough to facilitate coupling the flywheel jig with the flywheel.

6. The mechanism of claim 5, wherein the distal end of the arm of the jig carriage includes a bore therethrough, wherein the hub of the flywheel jig includes a shaft and a sleeve, the sleeve being rotatably and removably received on the shaft, and wherein the flywheel jig is coupled with the jig carriage by a proximal end of the shaft being removably received in the bore of the jig carriage.

7. The mechanism of claim 6, wherein the shaft has a body portion with an outer circumference that is slightly smaller than an inner circumference of the sleeve, wherein the shaft has a distal end with an outer circumference that is larger than the inner circumference of the sleeve to prevent the sleeve from sliding off the shaft from the distal end, and wherein the proximal end of the shaft has an outer circumference sized for receipt in the bore.

8. The mechanism of claim 7, wherein the arm of the jig carriage further includes an annular collar, a pivot pin and a stop plate, wherein the annular collar is connected to the distal end of the arm adjacent and co-axial with the bore to facilitate the coupling of the shaft with the arm, wherein the pivot pin is connected to the proximal end of the arm and facilitates the pivotal coupling of the arm to the body, and wherein the stop plate is coupled with the pivot pin and prevents rotational movement of the arm past a predetermined point in at least one direction by abutting a portion of the body.

9. The mechanism of claim 8, wherein the jack portion includes two stages, one of the stages being a lower pneumatic stage and the other of the stages being an upper hydraulic stage, wherein the piston and cylinder comprise the lower pneumatic stage, wherein the upper hydraulic stage also has a piston and a cylinder, and wherein the piston of the pneumatic stage defines the cylinder of the hydraulic stage, whereby the hydraulic stage is raised and lowered in the pneumatic cylinder.

10. A mechanism for raising and lowering parts of a vehicle during service thereon, the mechanism comprising:

a jack assembly having a mobile base with a jack portion supported thereon in a generally upright position, wherein the jack portion has a piston and a cylinder, a portion of the piston being slidably received in the cylinder and movable along a longitudinal axis of the jack assembly between extended and retracted positions, and wherein the piston has a distal end opposite the portion received in the cylinder;

a jig carriage coupled with the distal end of the piston and having a body and an arm, the arm having a proximal end which is pivotally coupled with the body and a distal end; and a clutch jig removably coupled with the distal end of the arm of the jig carriage for adapting the mechanism to couple with a clutch of the vehicle, wherein the clutch jig is an elongate cylindrical member having a longitudinal axis, wherein clutch jig includes a shaft and a sleeve, the sleeve being rotatably and removably received on the shaft, and wherein the clutch jig has a plurality of splines located on an exterior surface of the sleeve for sliding engagement with the vehicle clutch, the splines being generally parallel to the longitudinal axis of the clutch jig.

11. The mechanism of claim 10, wherein the clutch jig further includes at least one spline handle connected to the exterior surface of the sleeve for facilitating rotation of the sleeve about the shaft during use.

12. The mechanism of claim 10, wherein the distal end of the arm of the jig carriage includes a bore there through, wherein the clutch jig is coupled with the jig carriage by a proximal end of the shaft being removably received in the bore of the jig carriage, wherein the arm of the jig carriage further includes an annular collar, a pivot pin and a stop plate, wherein the annular collar is connected to the distal end of the arm adjacent and co-axial with the bore to facilitate the coupling of the shaft with the arm, wherein the pivot pin is connected to the proximal end of the arm and facilitates the pivotal coupling of the arm to the body, and wherein the stop plate is coupled with the pivot pin and prevents rotational movement of the arm past a predetermined point in at least one direction by abutting a portion of the body.

13. The mechanism of claim 12, wherein the jack portion includes two stages, one of the stages being a lower pneumatic stage and the other of the stages being an upper hydraulic stage, wherein the piston and cylinder comprise the lower pneumatic stage, wherein the upper hydraulic stage also has a piston and a cylinder, and wherein the piston of the pneumatic stage defines the cylinder of the hydraulic stage, whereby the hydraulic stage is raised and lowered in the pneumatic cylinder.

14. A mechanism for raising and lowering parts of a vehicle during service thereon, the mechanism comprising:

a jack assembly having a mobile base with a jack portion supported thereon in a generally upright position, wherein the jack portion has a piston and a cylinder, a portion of the piston being slidably received in the cylinder and movable along a longitudinal axis of the jack assembly between extended and retracted positions, and wherein the piston has a distal end opposite the portion received in the cylinder;

a jig carriage coupled with the distal end of the piston and having a body and an arm, the arm having a proximal end which is pivotally coupled with the body and a distal end; and a flywheel jig removably coupled with the distal end of the arm of the jig carriage for adapting the mechanism to couple with a flywheel of the vehicle, wherein the flywheel jig has a hub with a plurality of mounting bars extending therefrom at a distal end, wherein each of the mounting bars have a distal end spaced apart from the hub, wherein the flywheel jig is coupled to the distal end of the arm of the jig carriage at a proximal end of the hub, and wherein the distal ends of the mounting bars include an aperture there through to facilitate coupling the flywheel jig with the flywheel.

15. The mechanism of claim 14, wherein the distal end of the arm of the jig carriage includes a bore there through, wherein the hub of the flywheel jig includes a shaft and a sleeve, the sleeve being rotatably and removably received on the shaft, and wherein the flywheel jig is coupled with the jig carriage by a proximal end of the shaft being removably received in the bore of the jig carriage.

16. The mechanism of claim 15, wherein the shaft has a body portion with an outer circumference that is slightly smaller than an inner circumference of the sleeve, wherein the shaft has a distal end with an outer circumference that is larger than the inner circumference of the sleeve to prevent the sleeve from sliding off the shaft from the distal end, and wherein the proximal end of the shaft has an outer circumference sized for receipt in the bore.

17. The mechanism of claim 16, wherein the arm of the jig carriage further includes an annular collar, a pivot pin and a stop plate, wherein the annular collar is connected to the distal end of the arm adjacent and co-axial with the bore to facilitate the coupling of the shaft with the arm, wherein the pivot pin is connected to the proximal end of the arm and facilitates the pivotal coupling of the arm to the body, and wherein the stop plate is coupled with the pivot pin and prevents rotational movement of the arm past a predetermined point in at least one direction by abutting a portion of the body.

18. The mechanism of claim 17, wherein the jack portion includes two stages, one of the stages being a lower pneumatic stage and the other of the stages being an upper hydraulic stage, wherein the piston and cylinder comprise the lower pneumatic stage, wherein the upper hydraulic stage also has a piston and a cylinder, and wherein the piston of the pneumatic stage defines the cylinder of the hydraulic stage, whereby the hydraulic stage is raised and lowered in the pneumatic cylinder.

* * * * *